United States Patent [19]

Raman

[11] Patent Number: 4,778,516

[45] Date of Patent: Oct. 18, 1988

[54] PROCESS TO INCREASE YIELD OF FINES IN GAS ATOMIZED METAL POWDER

[75] Inventor: Ramaswamy V. Raman, Framingham, Mass.

[73] Assignee: GTE Laboratories Incorporated, Waltham, Mass.

[21] Appl. No.: 926,482

[22] Filed: Nov. 3, 1986

[51] Int. Cl.[4] ..... C22C 1/04; C22B 1/00

[52] U.S. Cl. ..... 75/0.5 C; 425/7

[58] Field of Search ..... 75/0.5 C; 425/7

[56] References Cited

U.S. PATENT DOCUMENTS

| | | | |
|---|---|---|---|
| 1,635,653 | 7/1927 | Williams | 75/0.5 B |
| 2,997,245 | 8/1961 | Nilsson et al. | 241/1 |
| 3,253,783 | 5/1966 | Probst et al. | 239/82 |
| 3,344,469 | 10/1967 | Bylund et al. | 18/2.5 |
| 3,430,289 | 3/1969 | Aikawa et al. | 18/2.5 |
| 3,501,802 | 3/1970 | Ullman et al. | 18/2.5 |
| 3,533,136 | 10/1970 | Holtz, Jr. | 18/2.5 |
| 3,592,391 | 7/1971 | Bender | 425/7 |
| 3,639,548 | 2/1972 | Ullman et al. | 264/12 |
| 3,695,795 | 10/1972 | Jossick | 425/7 |
| 3,752,611 | 8/1973 | Reed et al. | 425/7 |
| 3,817,503 | 6/1974 | Lafferty et al. | 266/34 R |
| 3,897,231 | 7/1975 | Massey | 75/0.5 C |
| 3,901,492 | 8/1975 | Lafferty | 266/34 R |
| 3,988,084 | 10/1976 | Esposito et al. | 425/7 |
| 4,080,126 | 3/1978 | Clark et al. | 425/7 |
| 4,194,900 | 3/1980 | Ide | 75/0.5 C |
| 4,272,463 | 6/1981 | Clark et al. | 264/12 |
| 4,274,864 | 6/1981 | Bernhardt | 75/0.5 R |
| 4,374,633 | 2/1983 | Hart | 425/7 |
| 4,382,903 | 5/1983 | Larsson et al. | 264/12 |
| 4,385,878 | 5/1983 | Larsson et al. | 425/7 |
| 4,386,896 | 6/1983 | Ray | 425/7 |
| 4,416,600 | 11/1983 | Lecznar et al. | 425/7 |
| 4,439,379 | 3/1984 | Hart | 264/12 |
| 4,575,325 | 3/1986 | Duerig | 425/7 |
| 4,619,597 | 10/1986 | Miller | 425/7 |
| 4,619,845 | 10/1986 | Ayers et al. | 427/422 |

FOREIGN PATENT DOCUMENTS

| | | |
|---|---|---|
| 2007129 | 5/1979 | United Kingdom . |
| 2154902 | 9/1985 | United Kingdom . |

OTHER PUBLICATIONS

Anderson et al., Submitted to *Metallurgical Transactions,* Sep. 20, 1984 (unpublished).

Backmark et al., *Powder Metallurgy International,* 18, pp. 338–340 (1986).

*Primary Examiner*—Peter D. Rosenberg

*Attorney, Agent, or Firm*—Frances P. Craig

[57] ABSTRACT

A method for producing ultrafine powder from a metal or metal alloy, including such high surface tension metals and alloys as copper, Cu-Al-Fe alloys and Ni-Cr-Fe-B-Si alloys. A stream of molten metal is atomized under aspiration conditions by a cone of impinging gas streams, the apex of the gas cone being 10–21 mm from the melt outlet and 11–24 mm from the gas orifices. The gas velocity is greater than Mach 1, and the mass flow ratio of melt to gas is less than 0.10.

20 Claims, 3 Drawing Sheets

PROCESS TO INCREASE YIELD OF FINES IN GAS ATOMIZED METAL POWDER

CROSS REFERENCE TO RELATED APPLICATIONS

This application is related to co-pending, commonly assigned U.S. patent application Ser. No. 076,448, filed Jul. 22, 1987, for PROCESS TO INCREASE YIELD OF FINES IN GAS ATOMIZED METAL POWDER USING MELT OVERPRESSURE.

BACKGROUND OF THE INVENTION

This invention relates to a method for producing ultrafine powder from a metal or metal alloy, and more particularly to such a method involving atomization of a stream of molten metal or metal alloy by an impinging cone of atomizing gas.

It is known to pass a stream of molten metal through a nozzle and to direct one or more high velocity jets of gas at the emerging stream to break up the stream into small droplets which solidify into particulates of varying sizes. Such gas atomization techniques are valuable for the production of prealloyed (multicomponent) systems as spherical particles which are clean and have low oxygen and nitrogen contents. However, a major disadvantage of prior art methods is the low yield of fine powders that can be obtained. The particle size distribution also tends to be broad, making control of the yield of fine powders even more difficult.

There is at present a growing industrial demand for ultrafine metal powders, i.e. powders having a particle diameter smaller than 10 microns. Presently only about 1% to 3% of the particles of industrially produced powder is within this ultrafine size range, making the cost of such powders verh high. Accordingly, there is a need to develop gas atomization techniques which can increase the yield of such ultrafine powder, and to narrow the particle size distribution.

The diameter of the particles and the size distribution are influenced by the surface tension of the melt from which the powder is produced. For melts of high surface tension, for example copper and copper alloys, production of fine powder is more difficult and consumes more gas and more energy.

Methods for the production of fine powder find particular usefulness in the field of rapid solidification materials. It is known that the rate of solidification of a molten particle of relatively small size in a convective environment such as a flowing gas is roughly proportional to the inverse of the diameter of the particle squared. Accordingly, if the average size of the diameter of the particles of the composition is reduced then the rate of cooling is increased dramatically. This property becomes particularly important in the production of amorphous metal and metal alloys. By producing metal powders having a narrow size distribution and a high percentage of ultrafine powders, novel amorphous and related properties may be achieved. Also, novel properties may be achieved in the production of superalloys.

Further, the achievement of smaller particle size and narrow size range can have advantages in the consolidation of materials by conventional powder metallurgy, resulting in a higher packing density and a higher sintering rate.

Recently, much experimentation has been performed to improve the atomization process. For example, various gas nozzles have been developed which use an ultrasonic, pulsed gas flow to atomize the melt. Other researchers have stated that high pressure gas flow directed in such a way as to produce aspiration or low pressure conditions at the melt outlet increases the production of fine powders, the percent of fines increasing with increasing aspiration. However, no method has as yet been successfully adapted to consistently and predictably produce a high percentage of ultrafine metal or metal alloy powder on a commercial scale.

SUMMARY OF THE INVENTION

The present invention presents to the art a method for atomizing molten metals and metal alloys, particularly high surface tension metals and metal alloys, to produce an amorphous ultrafine metal or metal alloy powder of which at least 30%, and usually at least 50% by weight has an average particle diameter of less than 10 microns.

In one embodiment of the invention, ultrafine powder is produced from a metal or metal alloy by a method involving delivering the metal or metal alloy as a melt from a melt source to an atomizing zone through a 1–7 mm diameter melt delivery orifice. The melt emerges from the orifice as a generally vertically oriented melt stream at a melt mass flow rate M. One or more streams of atomizing gas at a total gas mass flow rate G and a velocity $\geqq 333$ m/sec is directed from an annular gas orifice means concentric with the melt orifice toward the melt stream, so that the gas streams converge to generally define a cone the apex of which coincides with the tube axis and the gas streams impinge upon the melt stream at the atomizing zone at an average impingement angle of 20°–32.5° from the vertical to atomize the melt, and so that the gas pressure at the melt orifice is less than the melt pressure at the melt orifice. The apex of the gas stream cone is 10–21 mm from the melt orifice and 11–24 mm from the gas orifice means. The ratio $M/G \leqq 0.10$. The atomized melt is rapidly solidified to produce an amorphous ultrafine metal or metal alloy powder of which at least 30% by weight has an average particle diameter of $<10$ microns.

In a preferred embodiment of the method according to the invention, the metal or metal alloy is delivered as a melt from a melt source to an atomizing zone through a melt delivery tube. The tube includes a lower tip having a 1–7 diameter outlet and a tapered outer surface in the shape of an inverted truncated cone having a taper angle of about 20°–32.5° from the vertical. The melt emerges from the tip as a generally vertically oriented melt stream at a melt mass flow rate M. One or more streams of atomizing gas at a gas mass flow rate G and a velocity $\geqq 333$ m/sec is directed from an annular gas orifice means concentric with the tube opening toward the melt stream so that the gas streams converge to generally define a cone the apex of which coincides with the tube axis and the gas streams impinge upon the melt stream at the atomizing zone to atomize the melt, and so that the gas pressure at the tip outlet is less than the melt pressure at the tip outlet. The average impingement angle of the gas stream is about 20°–32.5° from the vertical and is greater than the tip taper angle by 0°–5.0°. The apex of the gas stream cone is 10–21 mm from the tip and 11–24 mm from the gas orifice means. The ratio $M/G \leqq 0.10$. The atomized melt is rapidly solidified to produce an amorphous ultrafine metal or metal alloy powder of which at least 30% by weight has an average particle diameter of $<10$ microns.

Either of the above described methods may be either a batch or continuous process. The preferred continuous methods involve continuously delivering the metal or metal alloy to a crucible means, and melting the metal or metal alloy therein. The delivery and melting steps both take place at an average rate equal to the mass flow rate of the melt being delivered from the crucible through the orifice or melt tube to the atomizing zone, so that a constant liquid level is maintained in the crucible.

BRIEF DESCRIPTION OF THE DRAWINGS

For a better understanding of the present invention, together with objects, advantages, and capabilities thereof, reference is made to the detailed description of the preferred embodiments and appended claims, together with the accompanying drawings, in which:

DETAILED DESCRIPTION OF THE PREFERRED EMBODIMENTS

Figure 1:
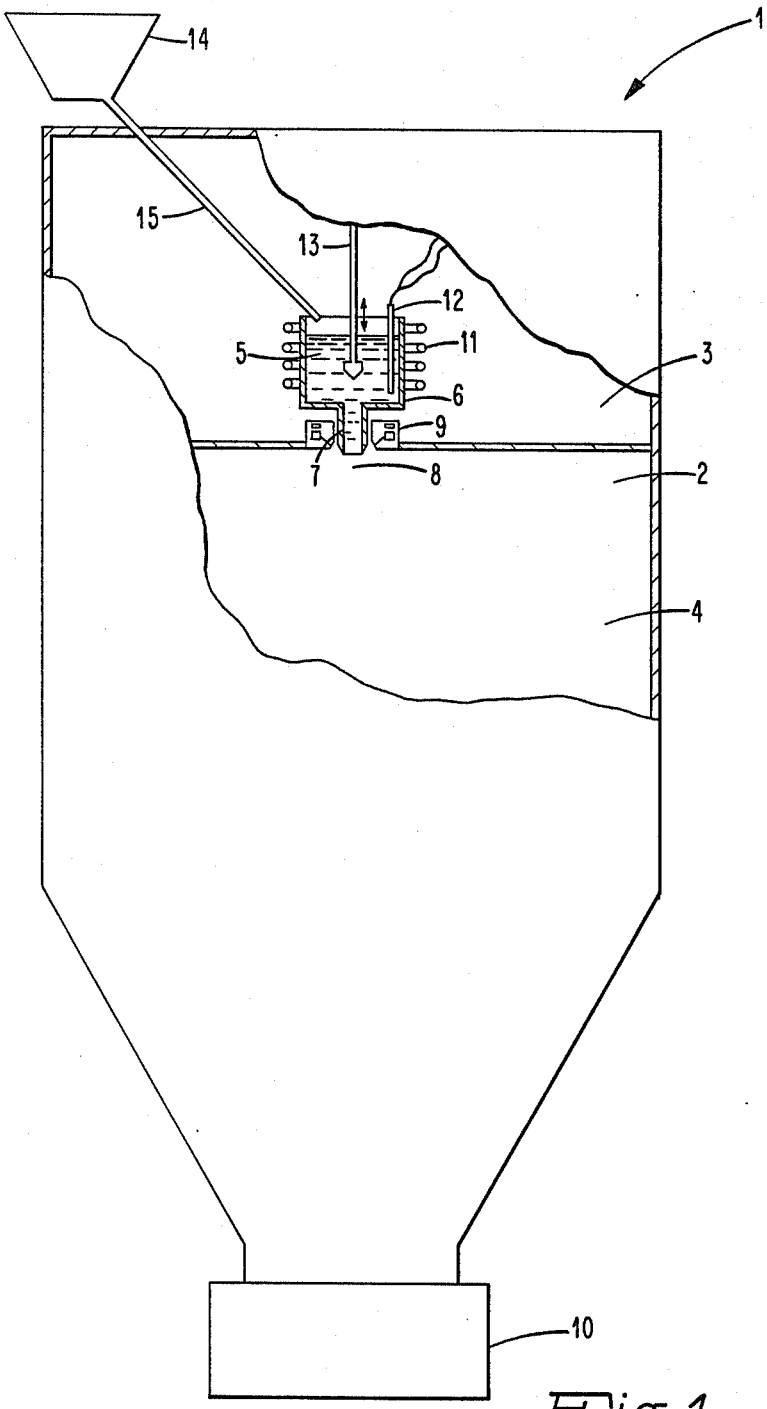
FIG. 1 is a schematic representation of a metal or metal alloy atomizing system according to the invention, partly in longitudinal section.

FIG. 1, schematically illustrates an exemplary gas atomizing system in which the preferred embodiments of the method according to the invention may be carried out. Atomizing system 1 includes atomizing chamber 2 including melting compartment 3 and atomizing compartment 4. A charge 5 of molten metal or metal alloy is discharged from melt crucible 6 through melt delivery nozzle or tube 7 to atomizing zone 8 as a narrow stream. A high pressure, high velocity gas stream from confined annular nozzle 9 impinges upon the melt stream in atomizing zone 8 to atomize the melt, which is then quenched as it falls downward in atomizing compartment 4 and is collected by powder collection means 10. Additional gas may be circulated in atomizing chamber 2, by known means (not shown), as a quenching gas to improve rapid solidification of the atomized melt, and to control the pressure in the atomizing compartment. If desired, the atmosphere within atomizing compartment 4 and melting compartment 3 may be separately controlled.

The melt may be maintained at a constant temperature in known manner by heating means 11. The temperature may be monitored in known manner, for example by thermocouple 12. Heating means 11 may then be adjusted in known manner to maintain a constant temperature. Stopper means, such as stopper rod 13 may be used in known manner to initiate or stop the flow of melt through tube 7.

The process may be carried out continuously, by continuously adding to charge 5 in crucible 6 additional solid or molten metal or metal alloy. FIG. 1 shows feed hopper 14, which may hold, for example, particles or chunks of metal or metal alloy, and conveying means 15, both of which cooperate to deliver the metal or metal alloy feed to crucible 6. The feed may be melted or preheated in hopper 14 or conveying means 15. Preferably the preheated feed is melted in crucible 6, by the heat from heating means 11. Most preferably the feed rate and melting rate are adjusted to equal the metal mass flow rate so that the liquid level in the crucible remains constant.

Figure 2:
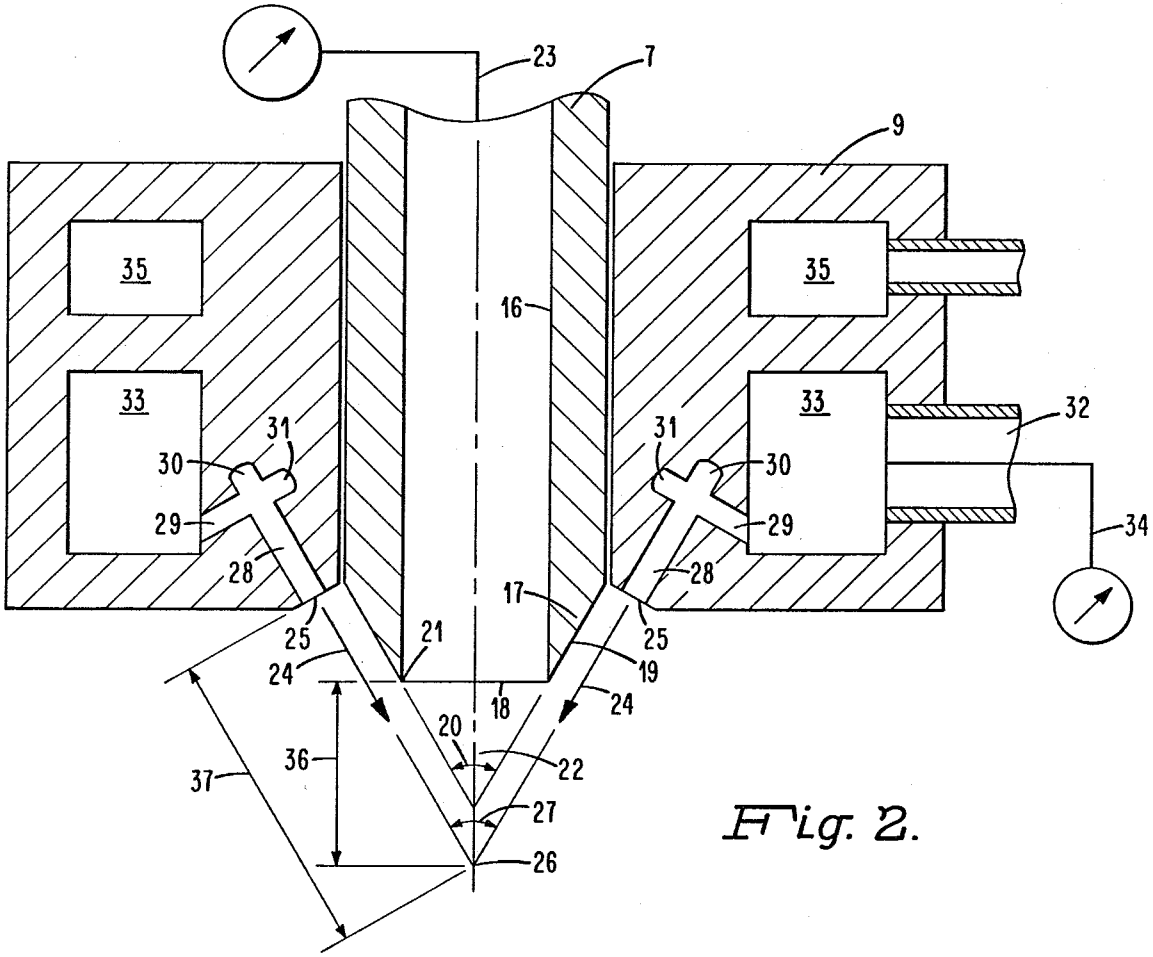
FIG. 2 is a schematic representation of a typical melt tube and gas nozzle arrangement used in the method according to the invention, shown in longitudinal section.

A schematic representation of a typical melt delivery tube 7 and gas nozzle 9 is illustrated in FIG. 2. Melt delivery tube 7 includes bore 16, and tip portion 17 providing tip outlet 18. The stream of melt flows generally vertically downward from tip outlet 18. Tip 17 is beveled or tapered to provide outer surface 19 in the shape of a truncated cone having an apex angle 20 of about 40°–65°. Tapered outer surface 19 extends across the entire thickness of the tube tip, providing edge 21 at outlet 18. Alternatively, surface 19 may extend only part way through the tip thickness, leaving for example an untapered horizontal or less sharply tapered portion (not shown) adjacent outlet 18. Also alternatively, tip portion 17 may have an untapered horizontal surface planar with outlet 18, omitting tapered surface 19. In either apparatus, tip portion 17 and outlet 18 preferably are disposed so as not to significantly obstruct the gas streams.

The melt flows from outlet 18 to atomization zone 22 at a mass flow rate M determined by the pressure of the gas at the tube outlet, the pressure of the melt in the melt tube, the density of the melt, and the cross-sectional area available in bore 16 for melt flow. The melt pressure in the tube may be monitored in known manner by sensor means 23. The melt flow rate may be controlled to some degree by changing the liquid level in crucible 6 (FIG. 1), or changing the cross-sectional melt tube flow area in bore 16, for example by using tubes having bores 16 of different internal diameters. Bore 16 is 1–7 mm, and preferably 3–5 mm, in diameter.

The melt stream delivered to atomizing zone 22 is atomized into droplets by gas jets 24 flowing from orifices 25 of gas nozzle 9 at a velocity ≧Mach 1 (333 m/sec). In the preferred nozzle 9, an annular array of 18 gas orifices are arranged in a single ring concentric with melt delivery tube 7. Alternatively, more or as few as 12 orifices may be arranged in one or more annular rings, or a gas jet may flow from an annular slit. The gas flow in all cases converges to generally define a cone, apex 26 of the cone coinciding with the axis of bore 16, and apex angle 27 being about 40°–65°. Apex angle 20 of tip 17 is no greater than apex angle 27 of the cone defined by the gas flow, and preferably the angles are approximately equal. Thus, in the preferred method, gas jets 24 follow a path tracing surface 19 sufficiently closely so that some of the gas glances off of surface 19, deflecting the gas downward to impinge the melt below apex 26.

In preferred gas nozzle 9 each of the 18 gas jets 24 flows from an orifice 25 defined by a first bore 28, which receives gas through a second bore 29 intersecting first bore 28 at a 90° angle. Bores 28 and 29 each extend beyond the intersection to form resonant spaces 30 and 31 respettively. Gas flows into bores 29 from a source (not shown) via gas inlet 32 and annular plenum chamber 33. The pressure of the gas in the nozzle may be monitored in known manner by sensor means 34.

The gas stream flows toward atomizing zone 22 at a mass flow rate G determined by the density of the gas, the total cross-sectional area available for gas flow through the bores (or in an alternate embodiment, through the annular slit), and the pressure of the gas in nozzle 9. The mass flow rate of the gas is most easily adjusted by changing the pressure of the gas in nozzle 9. The temperature of the gas may be controlled in known manner by circulating a heat transfer fluid through optional channel 35.

The atomizing gas is selected according to criteria including inertness to the metal or metal alloy being atomized, economic considerations, and the effectiveness of the gas in atomizing and/or rapidly solidifying the melt. For example, it has been found that argon and nitrogen, used in the method according to the invention, result in finer particles than helium under the same process conditions. However, helium is preferred when a more rapid solidification is desired.

Gas nozzle 9 is coaxial with tube bore 16 and is in a confined arrangement therewith, i.e. gas orifices 25 are in close proximity to outlet 18 of melt delivery tube 7. Since the energy available in the conical gas stream for atomizing the melt is inversely proportional to the distance travelled between leaving the gas orifices and impinging the melt, it is important that atomization zone 22 be as close as possible to confined gas nozzle 9 and melt delivery tube 7. It has been found that best results are obtained when distance 36 between gas cone apex 26 and outlet 18 is between 10 mm and 21 mm and when distance 37 between gas cone apex 26 and gas orifices 25 is between 11–24 mm. Distances 36 and 37 and to some degree the gas dynamics can be controlled by the geometries of nozzle 9 and melt tube 7 and their relative positions, for example as shown in FIG. 2 and described above.

It is known that creating a high pressure region at the melt tube outlet by means of the gas flow can result in backpressure, causing problems in the atomization process, including bubbling of the atomizing gas up through the melt in the tube and variations in and interruption of the melt flow. It is also known, as discussed above, that atomizing melt under aspirating conditions, i.e. lowering the gas pressure at the outlet to aspirate melt from the tube, can result in an increase in fine particles. The pressure at the tube outlet is influenced by the taper angle of the tip conical surface, by the vertical distance between the tube outlet and the gas cone apex, by the distance between the gas orifices and the gas cone apex, by the atomizing gas used, by the gas pressure at the nozzle inlet, by the effect of friction in the gas delivery system on the nozzle gas orifice pressure, and by changes in the gas dynamics after exiting the nozzle. Prior researchers report good yields of ultrafine tin alloy (Sn-5w/oPb) powders using aspiration, but at uneconomically high pressures, i.e., $>10$ MPa. Further, no results for high surface tension metals such as copper or copper alloys are reported.

It has been found that in addition to aspiration conditions, the percentage of ultrafine powders in atomized metals and metal alloys, including those of high surface area, depends upon the velocity at which the gas impinges upon the melt and upon the mass flow ratio of the metal flow rate to the gas flow rate, i.e. that a high gas velocity and low M/G ratio improves the percentage of fines. Since an increase in the metal mass flow rate M necessitates a proportional increase in the gas flow rate G to maintain the desired high percentage of fines, it is desirable for economic operation to control the pressure of the gas at the tube outlet, minimizing the aspiration of melt from the tube outlet without creating backpressure conditions.

The method according to the invention makes it possible to control the aspiration of melt, and to achieve at least 30% and normally at least 50% ultrafine (i.e. $<10$ microns) particles in an economical batch or continuous process readily adaptable to commercial use. The method is not limited to low surface tension metals such as tin alloys, but also achieves excellent results with high surface tension melts, e.g., Copper, Cu-Al-Fe alloys, or Ni-Cr-Fe-B-Si alloys.

The following Examples are presented to enable those skilled in the art to more clearly understand and practice the present invention. These Examples should not be considered as a limitation upon the scope of the invention, but merely as being illustrative and representative thereof.

EXAMPLE 1

Before the atomization process was begun, pressure measurements were made without melt flow to identify the configuration and conditions which would permit control of the aspiration conditions at the tube outlet. The apparatus used for atomization was similar to that illustrated in FIGS. 1 and 2 and described above.

The annular gas nozzle included a ring of 18 gas orifices provided by a 0.432 in diameter ring of 0.030 in diameter bores angled at 22.5° from the vertical, the ring diameter being measured center to center on opposing bores. The melt tube was 0.370 in O.D. with a 0.220 in central bore. The melt tube tip had a tapered conical surface at a taper angle of 22.5° from the vertical intersecting a narrow horizontal surface adjacent to the tube outlet.

The vertical distance that the tube outlet extended below the nozzle for this example was set at 0.060 in. The gas pressure was measured at the nozzle inlet, the aspiration/backpressure at the tube outlet.

The distances of the gas orifices and the melt outlet from the apex of the cone defined by the gas jets were 0.52 in and 0.42 in respectively; the apex of the gas cone was 45°.

Figure 3:
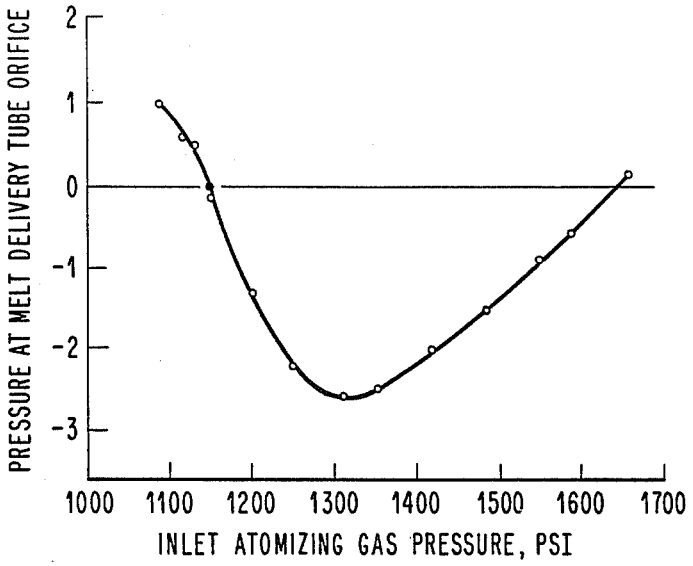
FIG. 3 is a graphical representation of gas pressures required to achieve aspiration in an exemplary atomizing process.

The gas pressure was varied from about 1080–1650 psi (7.5–11.4 MPa) to determine the gas pressure at the melt outlet. As shown in FIG. 3, aspiration conditions were achieved at about 1150–1640 psi (7.95–11.4 MPa) gas pressure.

EXAMPLES 2–6

For each example, a charge of copper of about 5 lbs was melted in the crucible of the apparatus of Example 1 and raised to 1500° C. in $N_2$ at about 2.6 psi pressure. Argon gas was circulated in the nozzle as a coolant. During atomization, the chamber pressure rose to 2.9 psi due the circulation of atomizing gas in the chamber. The charge was atomized using argon at gas velocities $\geqq$Mach 1 in a batch process.

Figure 4:
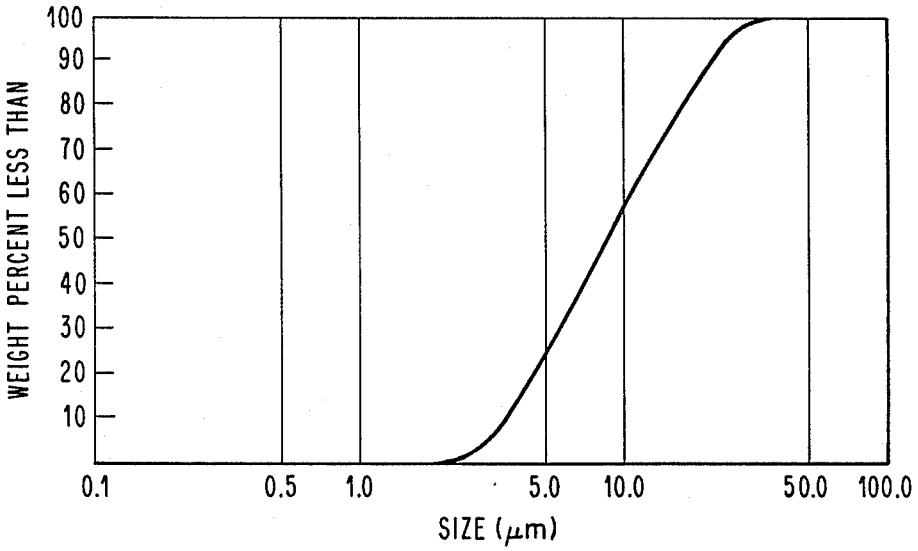
FIG. 4 is a graphical representation of a particle size distribution achieved by the method of the present invention.

The vertical distance that the tube outlet extended below the gas nozzle was 0.100 in; the distances represented by reference numerals 36 and 37 in FIG. 2 were 0.42 in and 0.52 in respectively. The atomized charge was rapidly solidified as it fell downward through the atomizing chamber and was collected and classified. The atomizing conditions and the results are shown in the Table. The particle size analysis from Example 2 is illustrated in FIG. 4. FIG. 4 shows the relationship between particle size and the weight percent of the particles collected which are below a particular particle size. The mean diameter of this particular atomizing example is the point at which the curve crosses the 50% line, i.e., about 9 microns. Similarly, the percent below 10 microns may be read from the Figure as about 57%.

TABLE

| Example | Charge Wt, g | Bore diam, cm | M, gps | G, gps | M/G |
|---|---|---|---|---|---|
| 2 | 2136 | 0.4 | 15.0 | 267.5 | 0.056 |
| 3 | 2309 | 0.4 | 15.1 | 226.0 | 0.067 |
| 4 | 2330 | 0.3 | 15.0 | 203.9 | 0.074 |
| 5 | 2256 | 0.3 | 15.1 | 193.7 | 0.078 |
| 6 | 2257 | 0.4 | 14.9 | 180.1 | 0.083 |

| Example | Melt P,psig | Initial Gas P, Psig | Final Gas P, Psig | Mean Particle Diam, μm |
|---|---|---|---|---|
| 2 | 1-2 | 2000 | * | 9 |
| 3 | 1-2 | 1500 | 1298 | 11 |
| 4 | 1-2 | 1350 | 1279 | 11 |
| 5 | 1-2 | 1400 | 1280 | 13 |
| 6 | 1-2 | 1250 | 1150 | 14 |

*Final pressure not recorded

While there has been shown and described what are at present considered the preferred embodiments of the invention, it will be obvious to those skilled in the art that various changes and modifications can be made therein without departing from the scope of the invention as defined by the appended claims.

We claim:

1. A method for producing ultrafine powder from a metal or metal alloy comprising the steps of:

delivering the metal or metal alloy as a melt from a melt source to an atomizing zone through a 1–7 mm diameter melt delivery orifice having a generally vertical axis, wherein the melt emerges from the orifice as a generally vertically oriented melt stream at a melt mass flow rate M;

directing one or more streams of atomizing gas at a total gas mass flow rate G and a gas velocity ≧333 m/sec from an annular gas orifice means concentric with the melt orifice toward the melt stream so that the gas streams converge to generally define a cone the apex of which coincides with the melt orifice axis and the gas streams impinge upon the melt stream at the atomizing zone at an average impingement angle of 20°–32.5° from the vertical to atomize the melt, and so that the gas pressure at the melt orifice is less than the melt pressure at the melt orifice, wherein the apex of the gas stream cone is 10–21 mm from the melt orifice and 11–24 mm from the gas orifice means, and the ratio M/G ≦0.10; and rapidly solidifying the atomized melt to produce an amorphous ultrafine metal or metal alloy powder of which at least 30% by weight has an average particle diameter of <10 microns.

2. A method according to claim 1 wherein the method is a batch process.

3. A method according to claim 1 wherein the method is a continuous process.

4. A method according to claim 3 wherein:

the melt source comprises a crucible means in the bottom of which is formed the melt delivery orifice; and further comprising the steps of continuously delivering the metal or metal alloy to the crucible means at an average rate equal to M; and continuously melting the metal or metal alloy in the crucible means at an average rate equal to M to form a reservoir of the melt, so that the liquid level of the melt reservoir in the crucible means remains substantially constant.

5. A method according to claim 4 wherein all of the steps take place in a chamber and further comprising the step of separately controlling the atmosphere and pressure in the chamber above and below the crucible means.

6. A method for producing ultrafine powder from a metal or metal alloy comprising the steps of:

delivering the metal or metal alloy as a melt from a melt source to an atomizing zone through a melt delivery tube having a generally vertical axis, wherein the tube includes a lower tip having a 1–7 mm diameter outlet and a tapered outer surface in the shape of an inverted truncated cone having a taper angle of about 20°–32.5° from the vertical, and the melt emerges o from the tip outlet as a generally vertically oriented melt stream at a melt mass flow rate M;

directing one or more streams of atomizing gas at a gas mass flow rate G and a gas velocity ≧333 m/sec from an annular gas orifice means concentric with the tip outlet toward the melt stream so that the gas streams converge to generally define a cone the apex of which coincides with the tube axis and the gas streams impinge upon the melt stream at the atomizing zone to atomize the melt, and so that the gas pressure at the tip outlet is less than the melt pressure at the tip outlet, wherein the average impingement angle of the gas streams is about 20°–32.5° from the vertical and is greater than the tip taper angle by 0°–5.0°, the apex of the gas stream cone is 10–21 mm from the tip outlet and 11–24 mm from the gas orifice means, and the ratio M/G ≦0.10; and rapidly solidifying the atomized melt to produce an amorphous ultrafine metal or metal alloy powder of which at least 30% by weight has an average particle diameter of <10 microns.

7. A method according to claim 6 wherein the gas orifice means is an annular gas nozzle including an annular gas jet slit concentric with the tube.

8. A method according to claim 6 wherein the gas orifice means is an annular gas nozzle including an annular array, concentric with the tube, of 12 or more gas jet orifices.

9. A method according to claim 8 wherein the gas nozzle includes 18 gas jet orifices in a single annular ring.

10. A method according to claim 6 wherein the atomizing gas is $N_2$ or Ar.

11. A method according to claim 6 wherein the atomizing gas is He.

12. A method according to claim 6 wherein the gas flow rate G is controlled by controlling the gas flow cross-sectional area, and pressure in the gas orifice means.

13. A method according to claim 12 wherein the pressure of the atomizing gas in the gas orifice means is about 47–136 atm, and the total gas flow area is 5.0 to 15.0 $mm^2$.

14. A method according to claim 6 wherein the melt flow rate M is controlled by controlling the melt flow cross-sectional area and pressure in the melt delivery tube.

15. A method according to claim 6 wherein all of the steps are carried out in a chamber and further comprising the step of controlling the atmosphere and pressure in the chamber.

16. A method according to claim 6 wherein the method is a batch process.

17. A method according to claim 6 wherein the method is a continuous process.

18. A method according to claim 17 wherein:

the melt source is a crucible means; and the melt delivery tube is operationally connected to the crucible means through an opening in the bottom of the crucible means; and further comprising the steps of:

continuously delivering the metal or metal alloy to the crucible means at an average rate equal to M; and continuously melting the metal or metal alloy in the crucible means at an average rate equal to M to form a reservoir of melt, so that the liquid level of the melt reservoir in the crucible means remains substantially constant.

19. A method according to claim 18 wherein all of the steps are carried out in a chamber and further comprising the step of separately controlling the atmosphere in the chamber above and below the crucible means.

20. A method for producing ultrafine powder from a high surface tension metal or metal alloy comprising:

delivering the metal or metal alloy as a melt from a melt source to an atomization zone through a melt delivery tube having a generally vertical axis, wherein the tube includes a lower tip having a 1–7 mm diameter outlet and a tapered outer surface in the shape of an inverted truncated cone having a taper angle of about 20°–32.5° from the vertical, and the melt emerges from the tip outlet as a generally vertically oriented melt stream at a melt mass flow rate M;

directing one or more streams of atomizing gas at a gas mass flow rate G and a gas velocity $\geqq 333$ m/sec from an annular gas orifice means concentric with the tip outlet toward the melt stream so that the gas streams converge to generally define a cone the apex of which coincides with the tube axis and the gas streams impinge upon the melt stream at the atomizing zone to atomize the melt, and so that the gas pressure at the tip outlet is less than the melt pressure at the tip outlet, wherein the average impingement angle of the gas stream is about 20°–32.5° from the vertical and is greater than the taper angle by 0°–5.0°, the apex of the gas stream cone is 10–21 mm from the tip outlet and 11–24 mm from the gas orifice means, and the ratio $M/G \leqq 0.10$; and rapidly solidifying the atomized melt to produce an amorphous ultrafine high surface tension metal or metal alloy powder of which at least 30% by weight has an average particle diameter of $<10$ microns.

* * * * *